US009829293B2

(12) United States Patent
Fricke et al.

(10) Patent No.: US 9,829,293 B2
(45) **Date of Patent: *Nov. 28, 2017**

(54) BARRIER-BLIND, LIMITED COLLATERAL DAMAGE PROJECTILE

(71) Applicants: Lehigh Defense, LLC, Quakertown, PA (US); Black Hills Ammunition, Inc., Rapid City, SD (US)

(72) Inventors: David B. Fricke, Quakertown, PA (US); Jeff Hoffman, Rapid City, SD (US)

(73) Assignees: Lehigh Defense, LLC, Quakertown, PA (US); Black Hills Ammunition Inc., Rapid City, SD (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/993,895

(22) Filed: Jan. 12, 2016

(65) Prior Publication Data

US 2017/0199020 A1 Jul. 13, 2017

(51) Int. Cl.
*F42B 12/04* (2006.01)
*F42B 5/16* (2006.01)

(52) U.S. Cl.
CPC ..... *F42B 12/04* (2013.01); *F42B 5/16* (2013.01)

(58) Field of Classification Search
CPC .. F42B 6/08; F42B 10/02; F42B 10/04; F42B 10/22; F42B 10/24; F42B 10/52; F42B 10/54; F42B 12/04; F42B 12/08; F42B 12/34
USPC ..... 102/501, 502, 506, 513, 529; D22/116
See application file for complete search history.

(56) References Cited

U.S. PATENT DOCUMENTS

| | | | | | |
|---|---|---|---|---|---|
| 33,863 | A * | 12/1861 | Woodbury | F42B 10/30 | 244/3.23 |
| 534,352 | A * | 2/1895 | Stuart | F42B 10/30 | 244/3.23 |
| 1,596,180 | A * | 8/1926 | Henderson | F42B 10/24 | 102/499 |
| 4,301,733 | A * | 11/1981 | Arciniega Blanco | F42B 7/10 | 102/448 |
| 4,700,630 | A * | 10/1987 | Sullivan | F42B 7/10 | 102/439 |
| 5,116,224 | A * | 5/1992 | Kelsey, Jr. | F42B 10/22 | 102/439 |
| 5,133,261 | A * | 7/1992 | Kelsey, Jr. | F42B 10/22 | 102/439 |
| 6,453,820 | B1 * | 9/2002 | Anderson | F42B 10/24 | 102/439 |
| D748,220 | S * | 1/2016 | Fricke | D22/116 | |
| 2013/0263754 | A1 * | 10/2013 | Neme | F42B 7/046 | 102/439 |
| 2015/0059610 | A1 * | 3/2015 | Amon | F42B 12/06 | 102/473 |

FOREIGN PATENT DOCUMENTS

WO WO 2016/007212 1/2016

* cited by examiner

*Primary Examiner* — Bret Hayes
(74) *Attorney, Agent, or Firm* — Merchant & Gould, P.C.

(57) ABSTRACT

A projectile has a body with three fins which partially define a meplat. Three flutes are alternatingly arranged with the three fins about an axis of the body. Each of the three flutes is at least partially defined by a curved surface having a substantially smooth radius of curvature that is substantially constant from the meplat to a side surface of the body.

20 Claims, 15 Drawing Sheets

BARRIER-BLIND, LIMITED COLLATERAL DAMAGE PROJECTILE

INTRODUCTION

Armor-piercing projectiles are typically used in military applications to penetrate metals, drywall, body armor, and other barriers. Typically, such projectiles include a flat meplat and a number of flutes that extend along the body of the projectile. By removing material from the bullet so as to form the flutes, the surface area of the meplat is reduced so as to enable penetration through barriers.

SUMMARY

In one aspect, the technology relates to a projectile having: a body having three fins, wherein the three fins at least partially define: a meplat; and three flutes alternatingly arranged with the three fins about an axis of the body, wherein each of the three flutes is at least partially defined by a curved surface having a substantially smooth radius of curvature that is substantially constant from the meplat to a side surface of the body. In an embodiment, the meplat has a meplat surface substantially orthogonal to the axis. In another embodiment, the meplat has a meplat portion extending substantially along the axis and away from the meplat surface. In yet another embodiment, each of the three flutes is at least partially defined by two curved surfaces, wherein the two curved surfaces intersect at an intersection curve defined by the radius of curvature. In still another embodiment, the body has a maximum outside diameter and the meplat has a meplat diameter about 50% of the maximum outside diameter.

In another embodiment of the above aspect, each of the three flutes each define a flute length between about 50% to about 55% of the body length. In an embodiment each of the three flutes each define a flute length between about 52% of the body length. In another embodiment, each flute has an included angle of about 120°.

In another aspect, the technology relates to a projectile having: a meplat surface; a base surface; and a body having an outer surface, the body extending along an axis from the meplat surface to the base surface, wherein the body has a plurality of fins, wherein each of the plurality of fins is defined by: the meplat surface; the outer surface; and a pair of curved surfaces, wherein adjacent curved surfaces of adjacent fins intersect at an intersection curve disposed radially equidistant from the adjacent fins. In an embodiment, adjacent curved surfaces of adjacent fins define a substantially symmetrical flute. In another embodiment, the body defines two flutes, wherein each flute has an included angle of about 150°. In yet another embodiment, the body defines three flutes, wherein each flute has an included angle of about 120°. In still another embodiment, the body defines four flutes, wherein each flute has an included angle of about 90°.

In another embodiment of the above aspect, the body has a maximum outer diameter of about 0.50" and at least one curved surface has a radius of about 0.3125". In an embodiment, the body has a maximum outer diameter of about 0.50" and at least one flute has a flute volume of about 0.216 cc.

In another aspect, the technology relates to a projectile having: a body having: an axis; a meplat substantially orthogonal to the axis; a plurality of substantially symmetrical fins defining and separated by a plurality of substantially symmetrical flutes, wherein each flute is formed by two curved surfaces of the body that intersect at an intersection curve. In an embodiment, at a leading point, the two curved surfaces have substantially similar radii of curvature. In another embodiment, each of the plurality of substantially symmetrical flutes is symmetrical about the intersection curve. In yet another embodiment, the plurality of substantially symmetrical flutes has three substantially symmetrical flutes. In still another embodiment, each of the plurality of symmetrical fins has a chisel.

BRIEF DESCRIPTION OF THE DRAWINGS

There are shown in the drawings, embodiments which are presently preferred, it being understood, however, that the technology is not limited to the precise arrangements and instrumentalities shown.

DETAILED DESCRIPTION

Figure 1A:
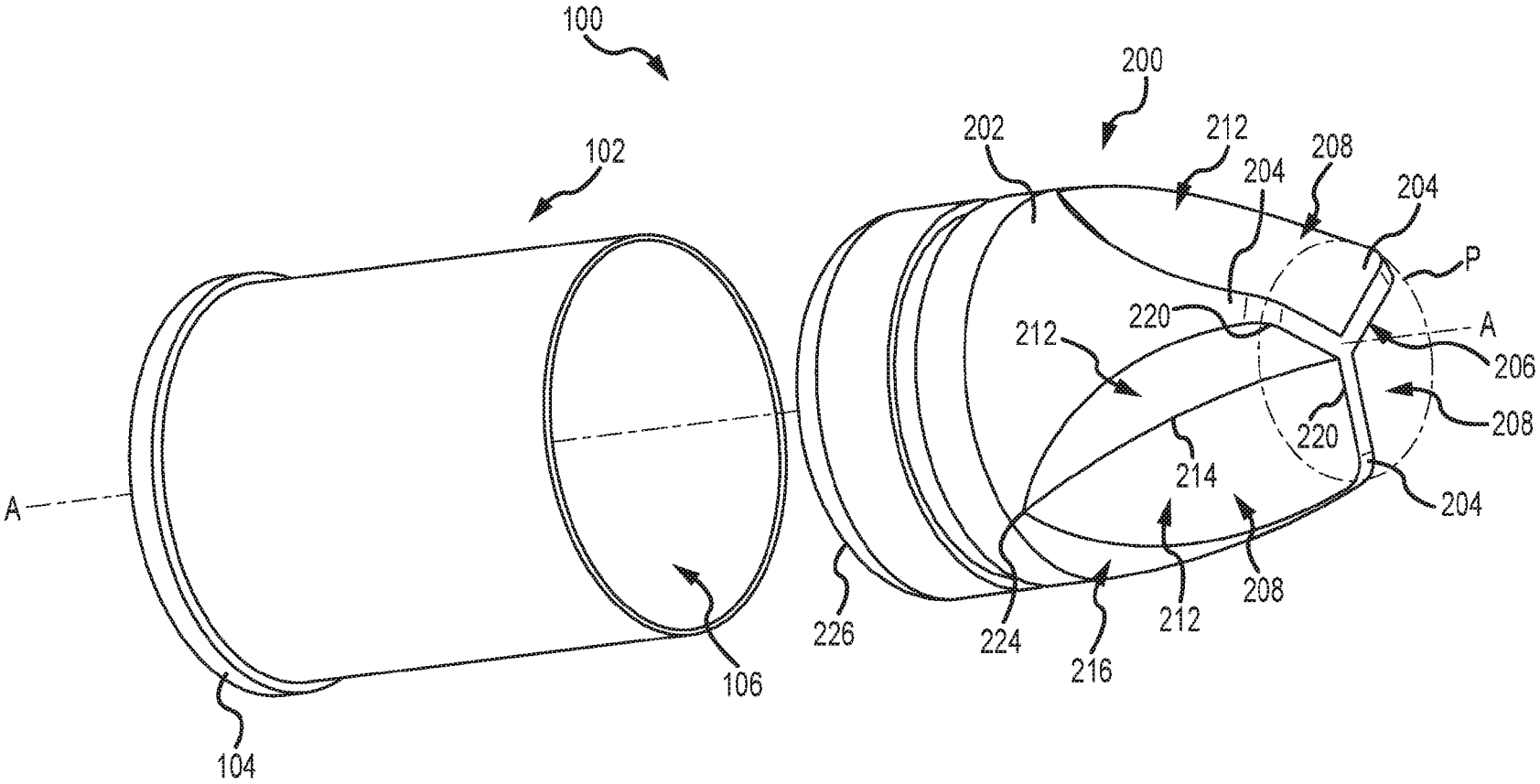
FIG. 1A is an exploded perspective view of an embodiment of a cartridge utilizing an armor-piercing projectile.
Figure 1B:
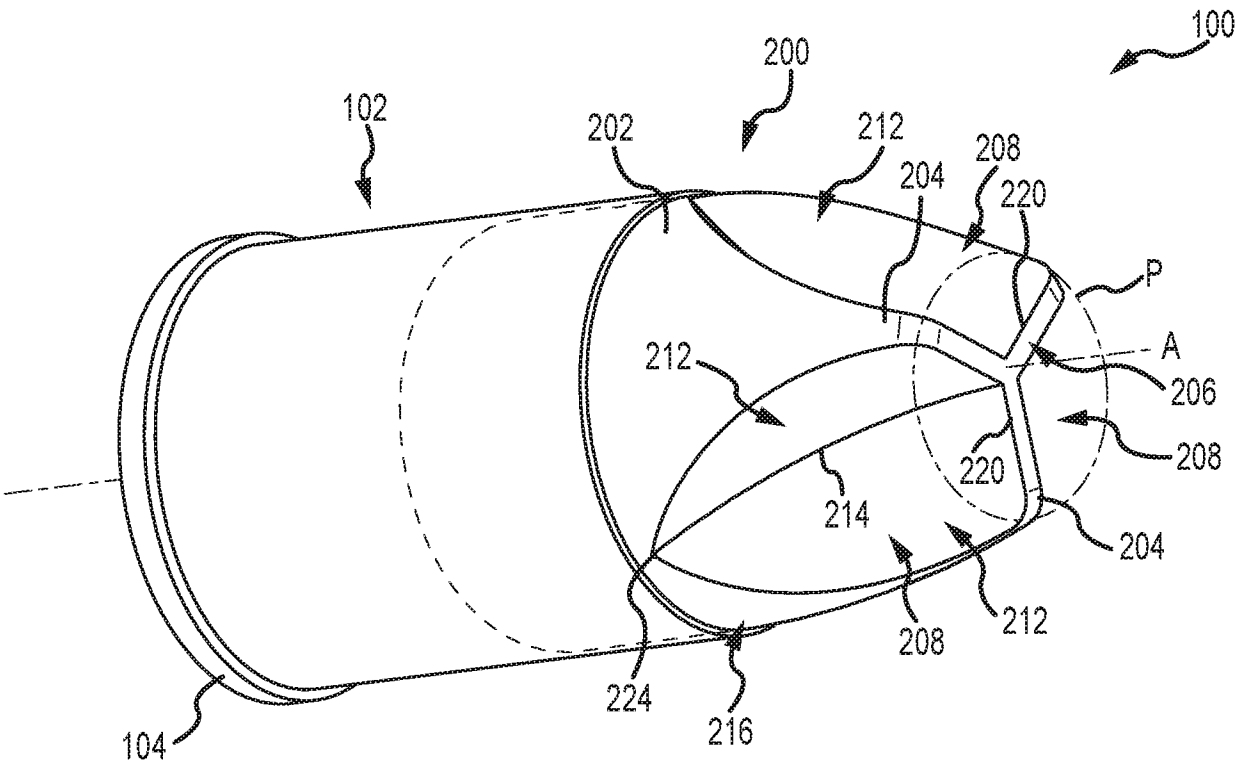
FIG. 1B is a perspective view of the cartridge of FIG. 1A.

FIGS. 1A and 1B are exploded perspective and perspective views, respectively, of an embodiment of a cartridge 100 utilizing an armor-piercing projectile 200. These figures are described simultaneously, along with FIG. 1C, which depicts a meplat end view of the armor-piercing projectile 200. The cartridge 100 includes an annular casing 102 having a primer (not shown) disposed at a first end 104 thereof, as well-known in the art. The casing 102 includes an open second end 106 into which the projectile 200 is inserted during manufacture and assembly. The interior of the casing 102 is filled with a propellant (e.g., gunpowder) that is ignited by the primer. This ignition discharges the projectile 200 from a firearm, such as a handgun. In so-called "automatic weapons," the force of the explosion is sufficient to both discharge the projectile and cycle a new cartridge into the weapon's firing chamber. The projectile 200 includes a body 202 that includes a plurality of fins 204 that form a meplat 206 of the projectile 200. The meplat 206 is the generally flat leading surface of the projectile 200 that defines a plane P, which is substantially orthogonal to an axis A of the projectile 200. In the depicted example, the projectile 200 includes three fins 204 that are spaced from each other by, and define, a corresponding number of longitudinal flutes 208. Other numbers of fins and flutes are contemplated and are described herein.

The fins 204 have a minimum thickness t (at the meplat 206) and expand as the distance from the meplat 206 increases. A thin minimum thickness t of the fins 204 at the meplat 206 helps the projectile more easily penetrate a barrier once fired from a firearm. The width w of the flutes 208 vary as the distance from the meplat plane P increases. In the depicted example, the flutes 208 are each defined by two curved surfaces 212 that also form surfaces of the fins 204. Each curved surface 212 may be substantially constant in radius of curve time along its length (from the meplat 206 towards a base 226 of the projectile). In another example, the curved surfaces 212 may start a distance away from the meplat 206, thus defining a meplat portion, for example, meplat portion 310 (shown in FIG. 4) that has walls substantially parallel to the axis A, prior to beginning the curved surface 212. These curved surfaces 212 intersect at an inner intersection curve 214 that is radially equidistant from adjacent fins 204. As such, the flutes 208 are symmetrical. The flutes 208 are formed in a curved outer surface 216 (an ogive) of the projectile 200.

Figure 1C:
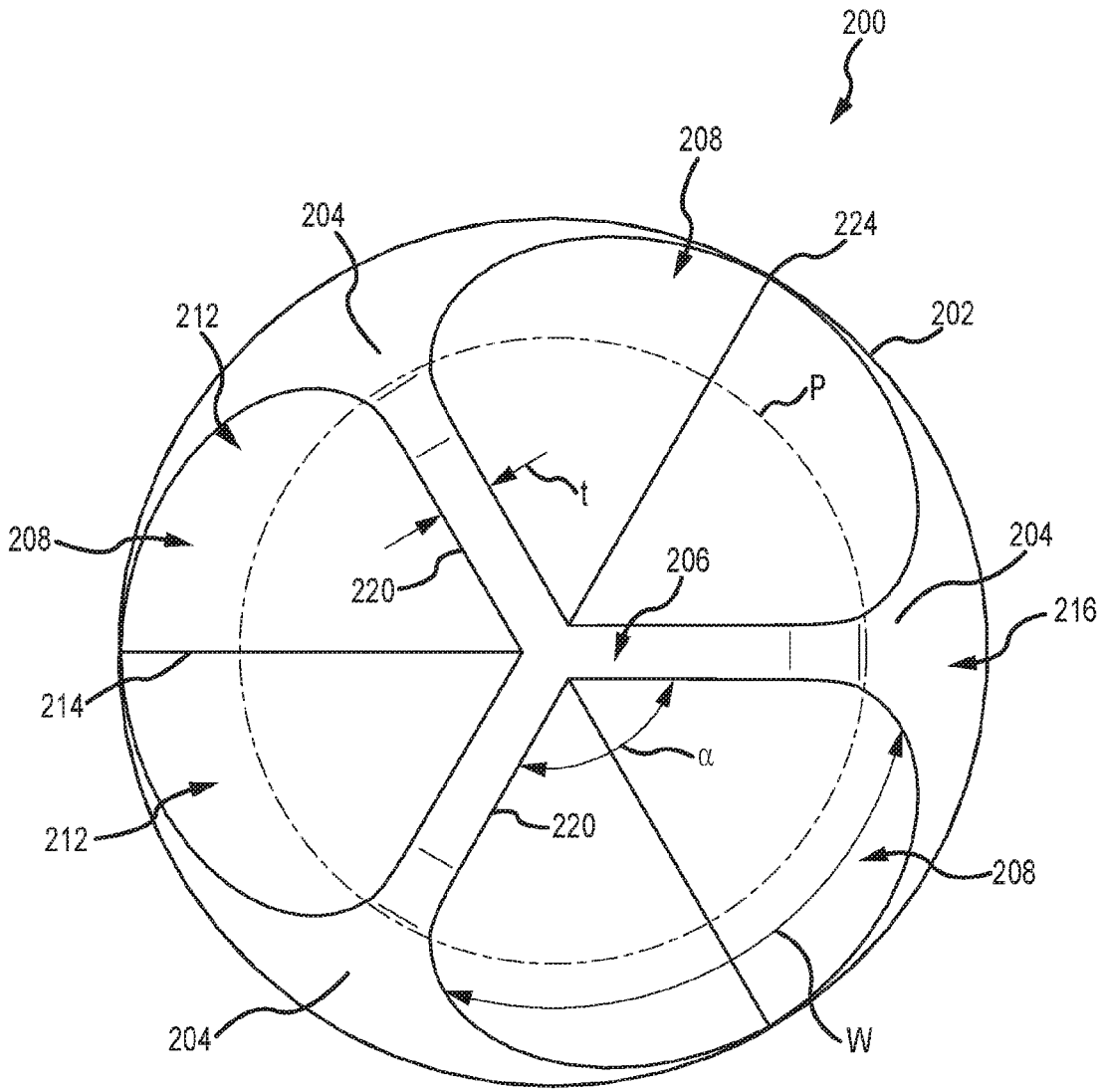
FIG. 1C is a meplat end view of the armor-piercing projectile of FIG. 1A.
Figure 1D:
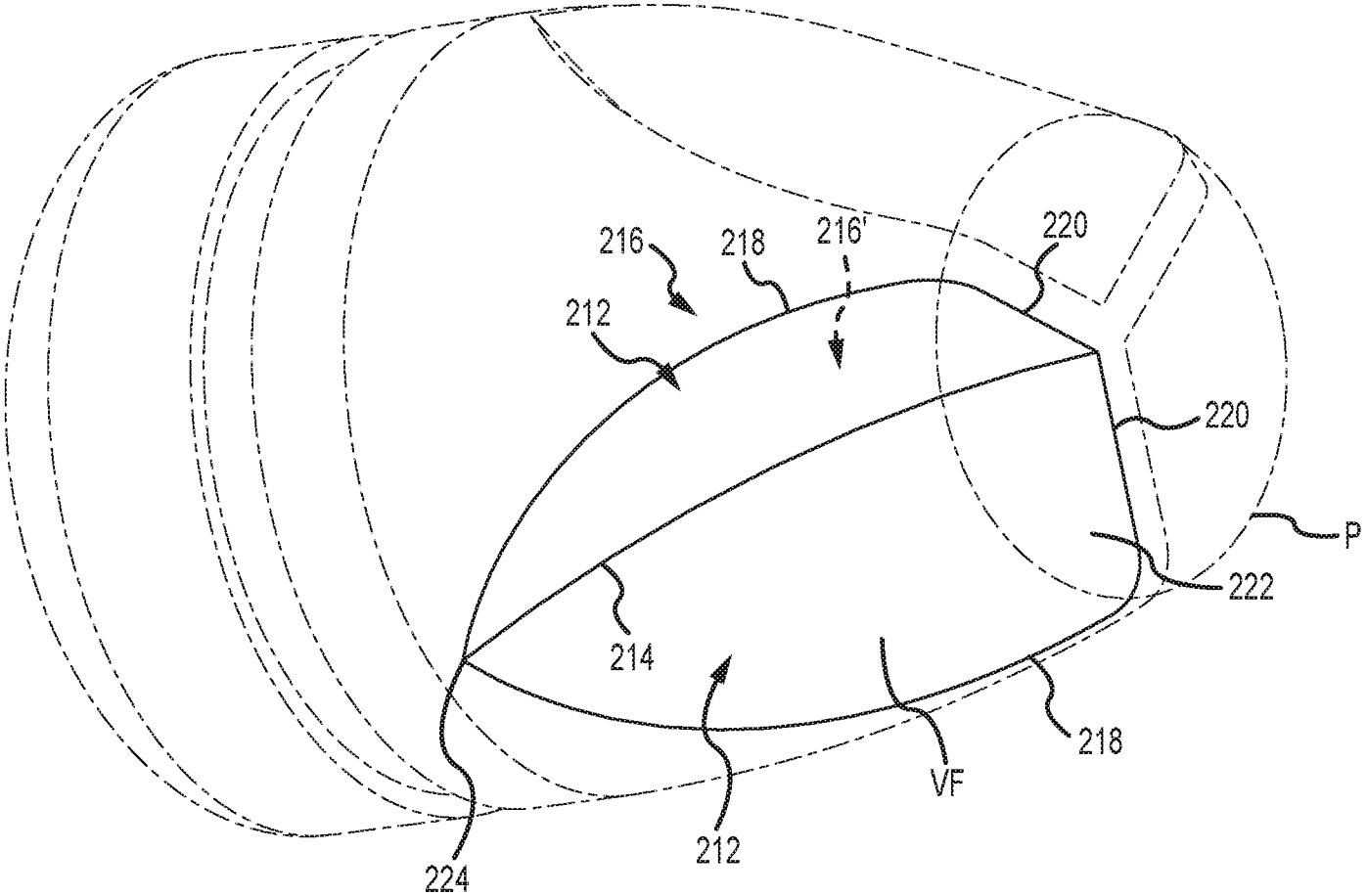
FIG. 1D is a perspective view of a flute volume of the armor-piercing projectile of FIG. 1A.

As depicted in FIG. 1C, each flute 208 has an included angle α, which can vary as required or desired for a particular application, projectile caliber, and so on. The number of fins 204 may further limit the size of the included angle α. Each flute 208 may be defined by a flute volume $V_F$, which is defined by a number of real surfaces and reference surfaces. FIG. 1D depicts the flute volume $V_F$, which is defined by the two curved surfaces 212, the plane P, and the reference outer surface 216' (that is, the outer surface 216 that would be present but for the presence of the flute 208). For clarity, these the curved surfaces 212 intersect at the inner intersection curve 214. Each curved surface 212 also intersects the curved outer surface 216 of the projectile 200 at outer intersection curves 218. Additionally, each curved surface 212 intersects the plane P at a fin edge 220, while the reference outer surface 216' intersects the plane P at a meplat curve 222. As such, these curves, edges, real surfaces, and reference surfaces substantially define the flute volume $V_F$.

The curved surfaces 212 define a curve generally along the axis A. That is, in the depicted examples, the curved surfaces 212 are curved from the fin edge 220 to a flute termination point 224. In other examples, however, the curved surfaces 212 may also be curved from the outer intersection curve 218 to the inner intersection curve 214. In such examples, the curved surfaces 212 would be concave.

The armor-piercing projectile described herein may be manufactured as monolithic solid copper or brass. Other acceptable materials include copper, copper alloy, copper-jacketed lead, copper-jacketed zinc, copper-jacketed tin, powdered copper, powdered brass, powdered tungsten matrix, steel, stainless steel, aluminum, tungsten carbide, and like materials. The narrow minimum thickness t of the flutes 208 at the meplat 206 enable the projectile 200 to penetrate hard surfaces during flight. Thus, the projectiles described herein are barrier-blind to hide, hair, bone, clothing, drywall, car doors, etc. Barriers that would destroy a lead or lead-core projectile are easily breached with a projectile manufactured as described herein. The flutes 208 of the armor-piercing projectile generate large amounts of hydraulic force when the projectile 200 hits a so-called "wet target." Wet targets include, for example, animals and persons, as well as water (in discharge testing tanks), and gel ordnance test blocks. As the projectile 200 moves forward within a wet target, fluid (water, blood, etc.) that enters the flutes 208 travels along and within the flutes 208 from the meplat 206 towards the flute termination point 224. More accurately, as the projectile 200 moves forward in the wet target, fluid that is within the path of travel of the projectile 200 (e.g., within the flute volume $V_F$) is thrown violently outward due to hydraulic pressure as that fluid reaches the portions of the curved surfaces 212 proximate the termination point 224. Thus, fluid that enters the flutes 208 is ejected therefrom by a strong hydraulic force. As such, the fluid is projected substantially radially outward from the axis A of the projectile 200, creating a larger wound cavity and resulting in a cleaner kill.

Figure 2A:
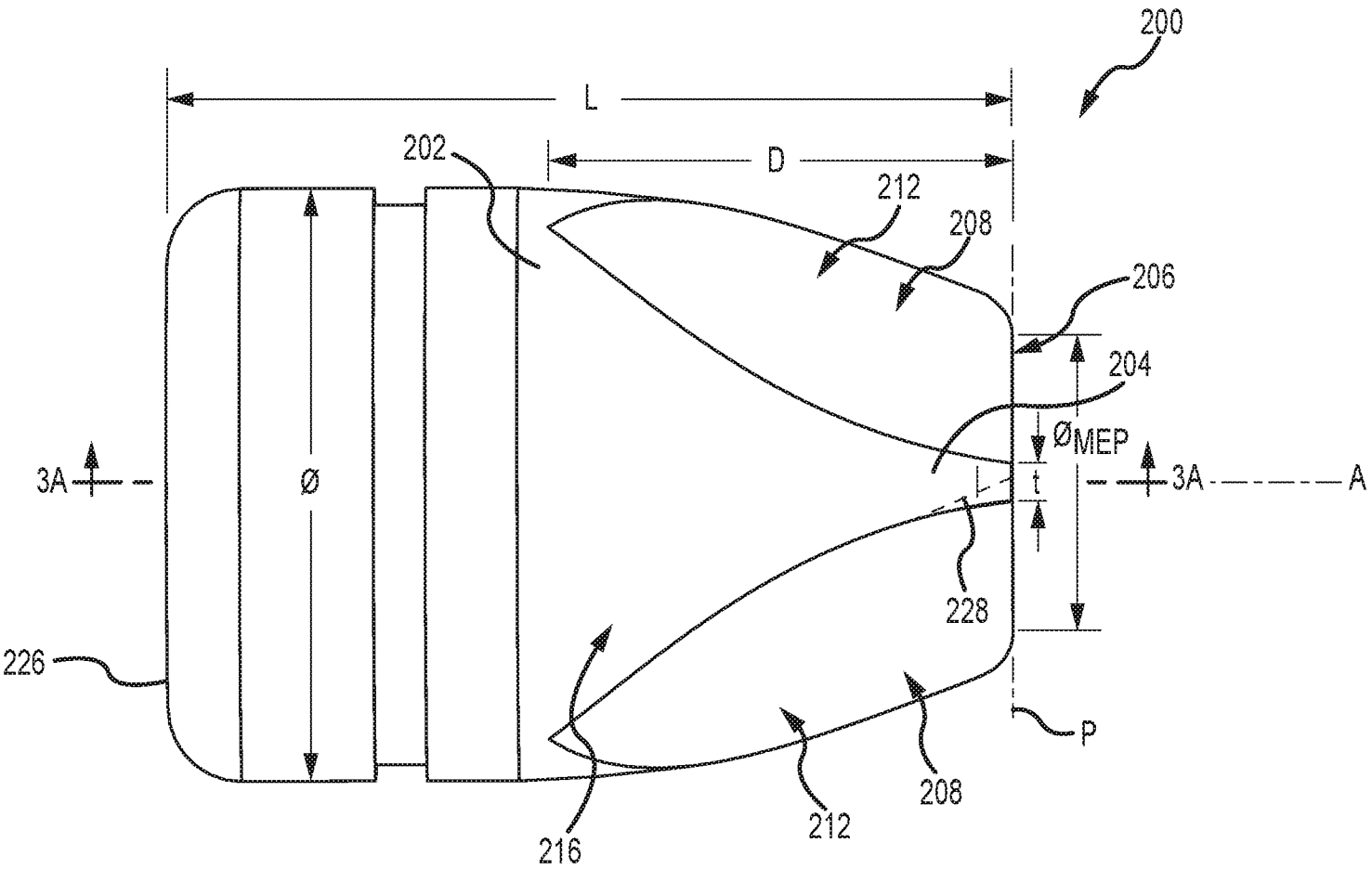
FIG. 2A is a first side view of the armor-piercing projectile of FIG. 1A.
Figure 2B:
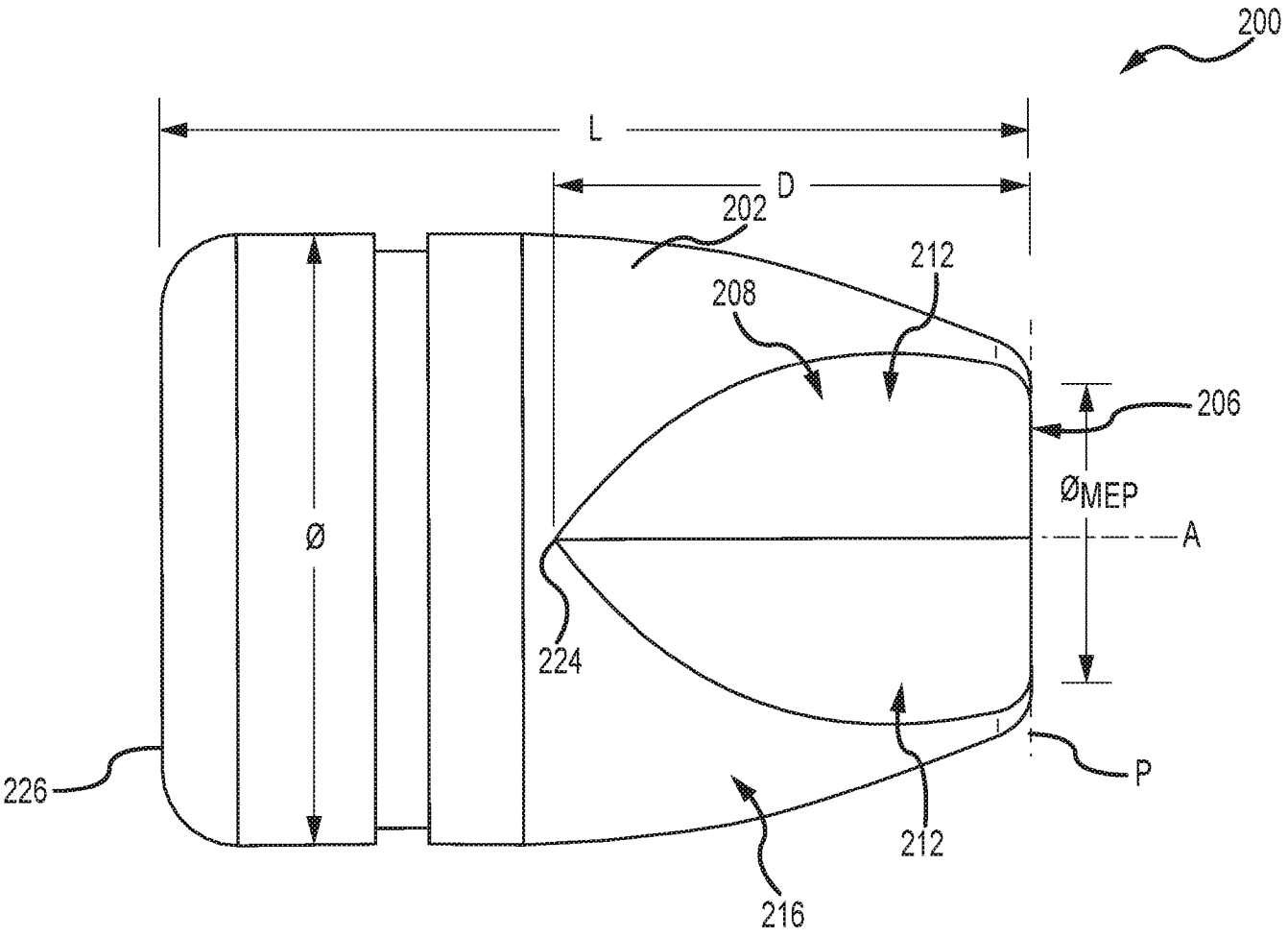
FIG. 2B is a second side view of the armor-piercing projectile of FIG. 1A.
Figure 3:
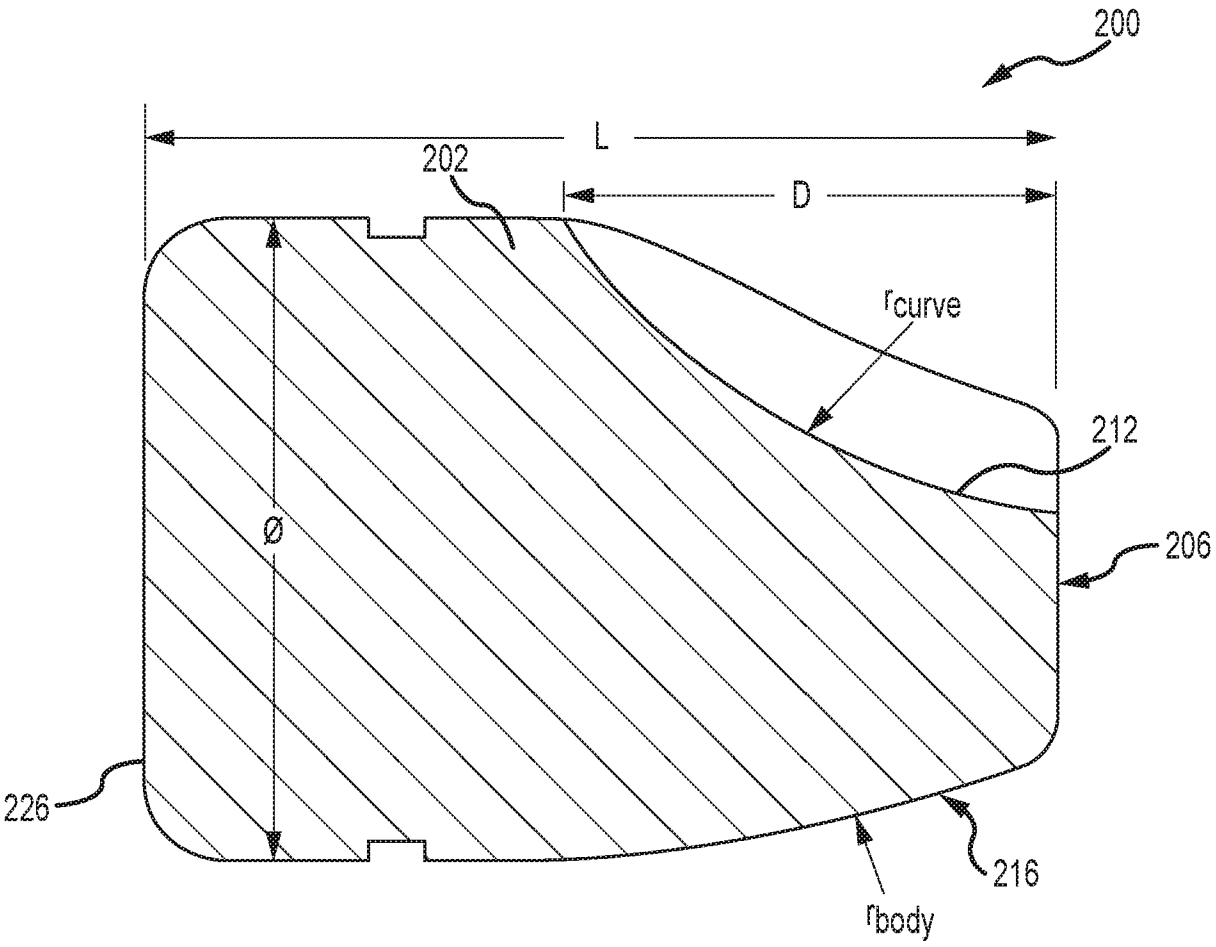
FIG. 3 is a side sectional view of the armor-piercing projectile of FIG. 1A.

FIGS. 2A and 2B are first and second side views, respectively, of the armor-piercing projectile 200 of FIG. 1A. The projectile body 202 has a length L and a caliber Ø (e.g., the maximum body diameter). Each flute 208 has a flute depth D, as measured along an axis A of the projectile body 202, from the meplat plane P to the termination point 224. The meplat 206 has a meplat diameter $Ø_{MEP}$ at the meplat plane P. The depicted projectile body 202 includes three flutes 208, separated by an equal number of fins 204. In other examples, a greater or fewer number of fins and flutes may be utilized as required or desired for a particular application. Projectiles having as few as two flutes/fins or as many as four flutes/fins are contemplated and are depicted herein. The fins 204 include a minimum thickness t at the meplat plane P. The minimum thickness t may be measured linearly across a width of the fin 204 at the meplat plane P. FIG. 3 is a side sectional view of the armor-piercing projectile 200 of FIG. 1A. The curved surface 212 of the flute 208 includes a curve radius $r_{curve}$. A portion of the body 202 from the meplat plate P to proximate the termination point 224 is defined by a body radius $r_{body}$.

The relationships between the various components of the projectile 200 help ensure proper operation during firing and striking of a target. Once discharged from a firearm, the projectile 200 flies towards a target. When striking a wet target, fluid within the target is forced into the flutes 208. This fluid continues to travel through the flutes 208, towards a base 226 of the projectile 200. As the fluid reaches the reference curve 212 proximate the termination point 224, the fluid is forced outward (substantially radially away from the axis A), so as to create a large wound in the target. A chisel 228 (depicted by a dashed line in FIG. 2A) may be disposed proximate the meplat 206. This chisel 228 further reduces the thickness t of the meplat 206, thus improving barrier penetration. The chisel 228 is located such that the curved surface 212 does not begin until the end of the chisel 228.

The various dimensions of the components described above may be modified as required or desired for a particular application. Certain ratios have been discovered to be particularly beneficial to ensure significant cavity formation during contact with a wet target as well as to ensure proper feeding from a magazine of an automatic weapon. For example, the flute depth D, as measured along axis A from the meplat plane P may be between about 50% to about 55% of the total projectile length L. In another example, the flute depth D may be about 52% of the total projectile length L. The meplat diameter $Ø_{MEP}$ at the meplat plane P may be between about 50% to about 55% of the maximum body diameter Ø (e.g., the caliber). In a more specific example, the meplat diameter $Ø_{MEP}$ may be about 52% of the maximum body diameter Ø. Such a meplat diameter $Ø_{MEP}$ allows the cartridge to be fed in an automatic weapon without interference. Other geometric relationships are contemplated and are described below. The dimensions of the various portions of the disclosed projectiles assist in enabling those projectiles to function properly when hitting a wet target.

Figure 4:
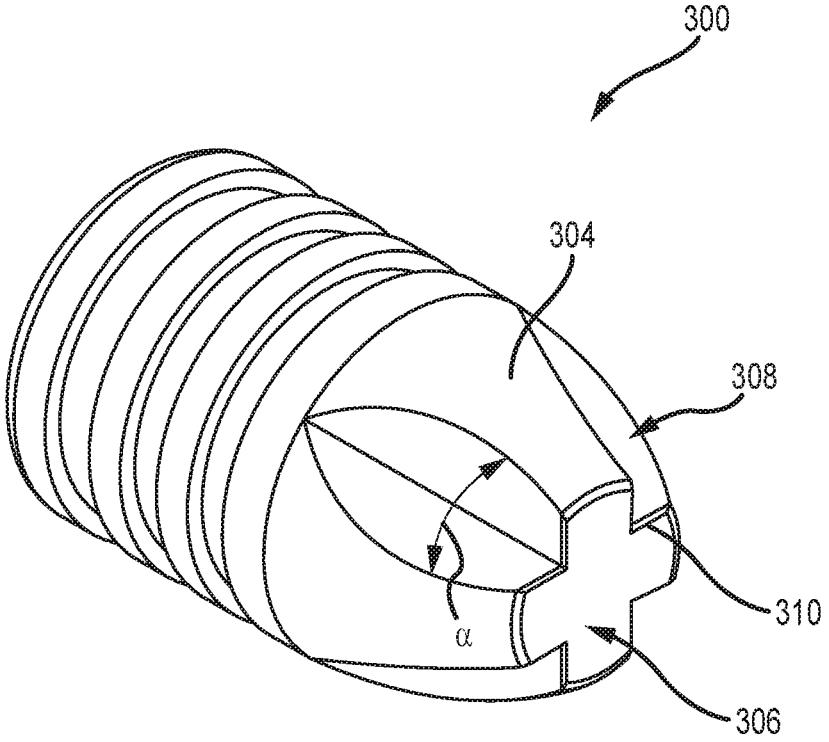
FIG. 4 depicts a perspective view of another example of an armor-piercing projectile.
Figure 5A:
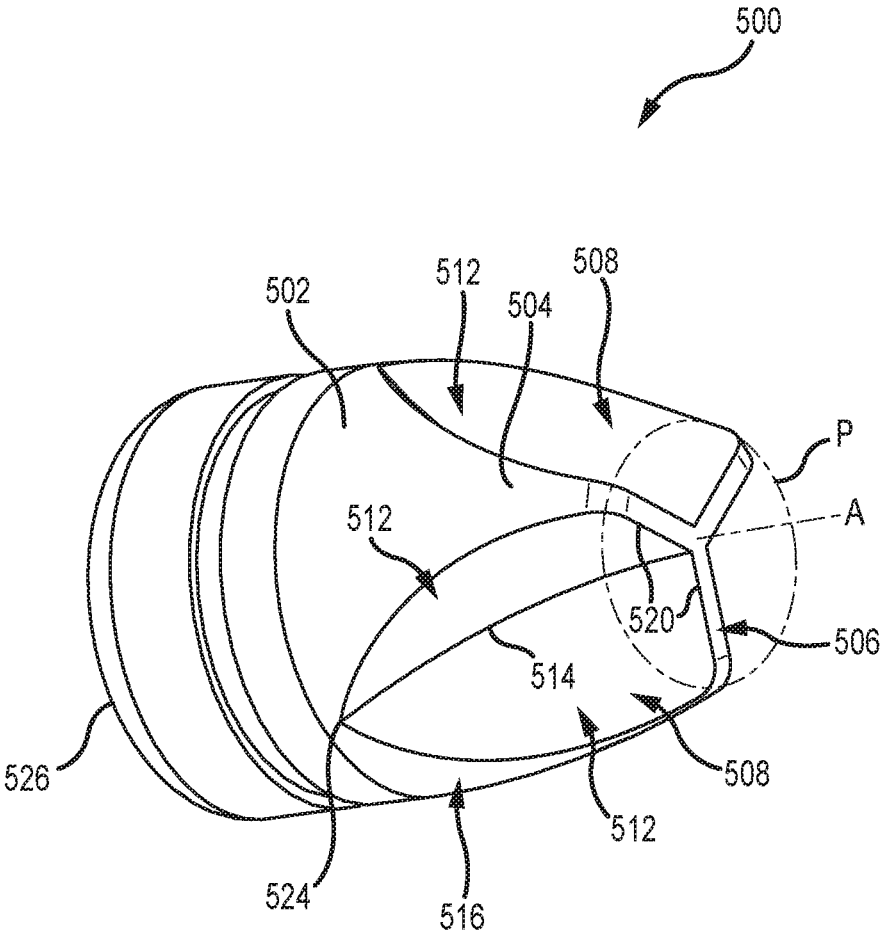
FIGS. 5A-5E depict various views of another embodiment of an armor-piercing projectile.
Figure 5B:
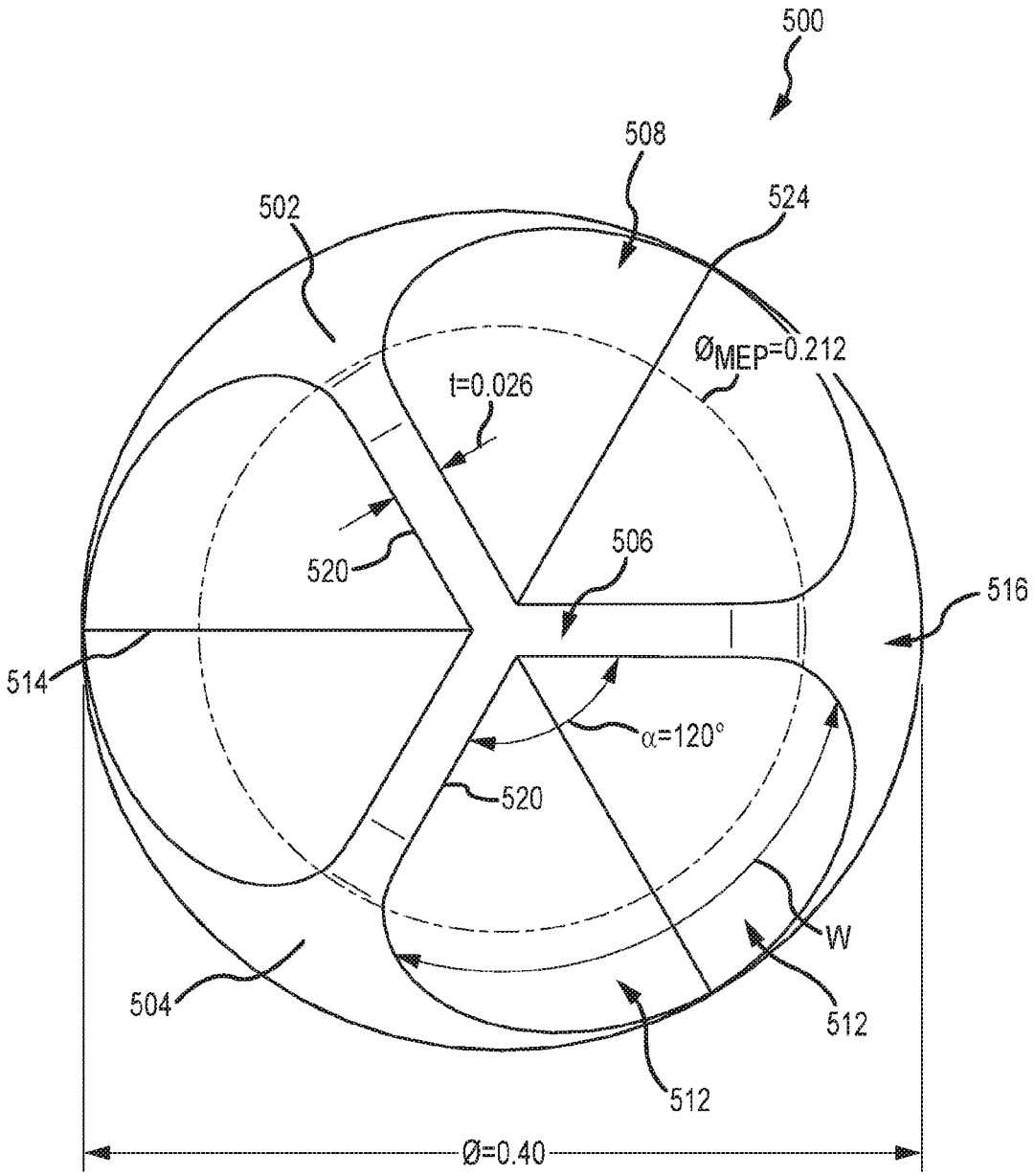
Figure 5C:
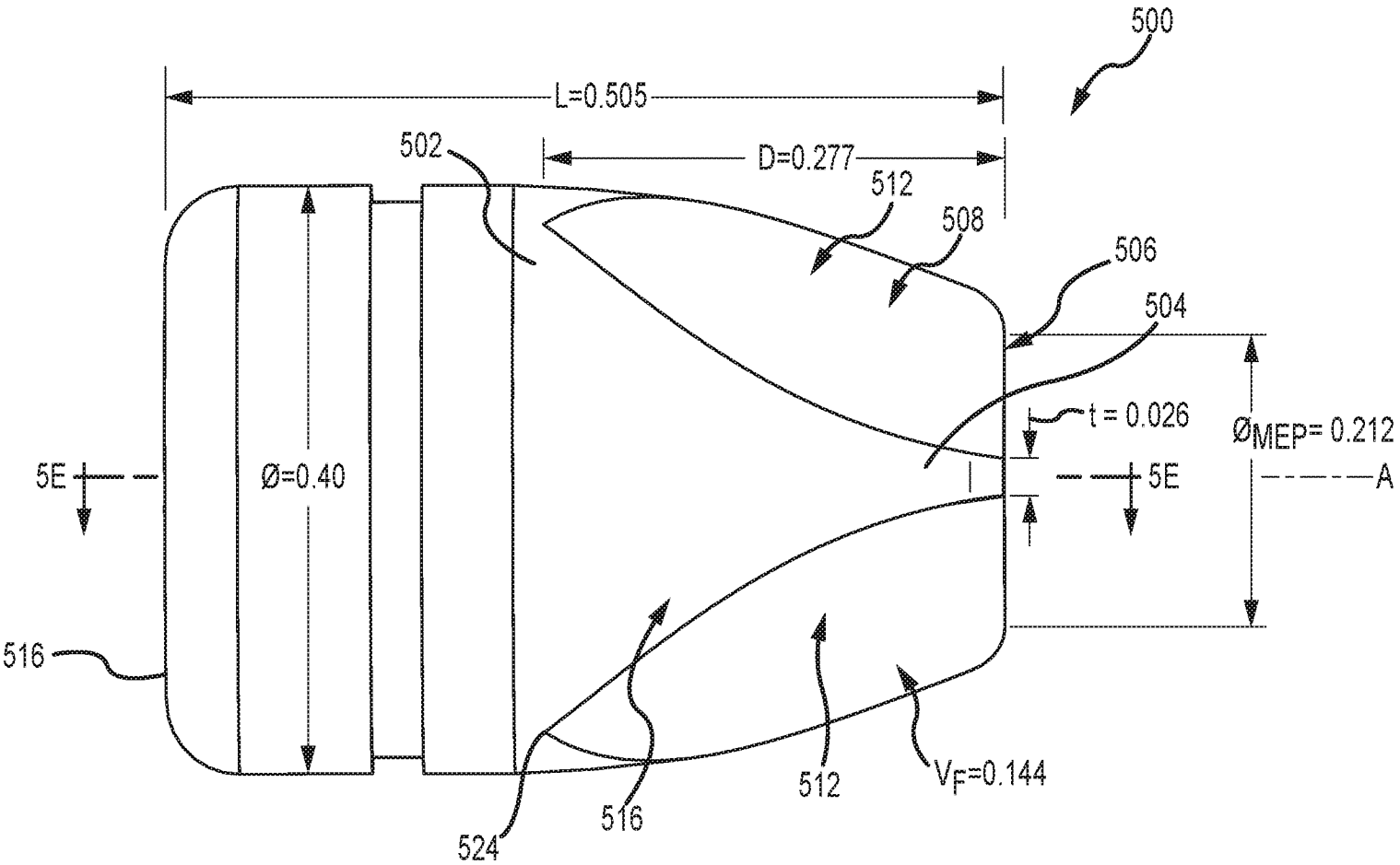
Figure 5D:
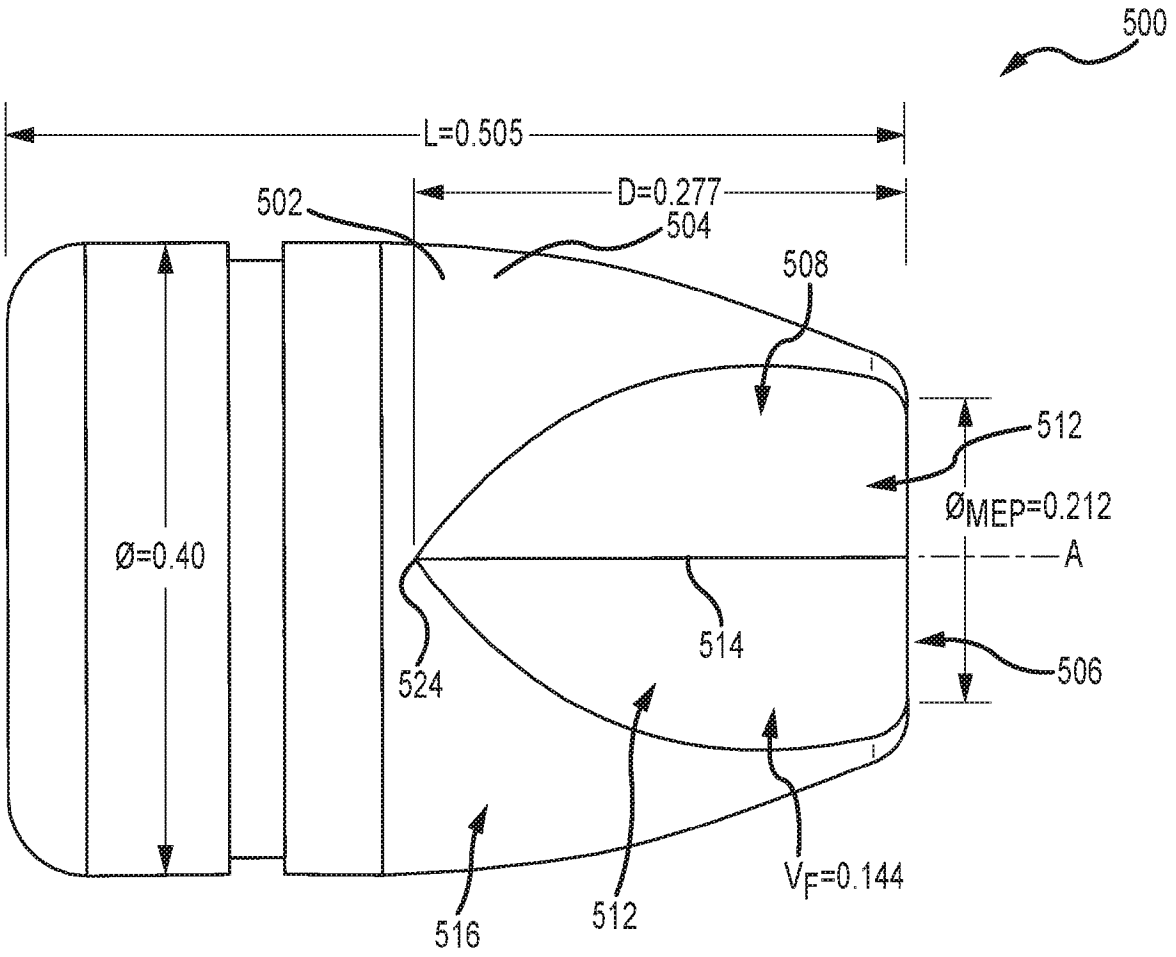
Figure 5E:
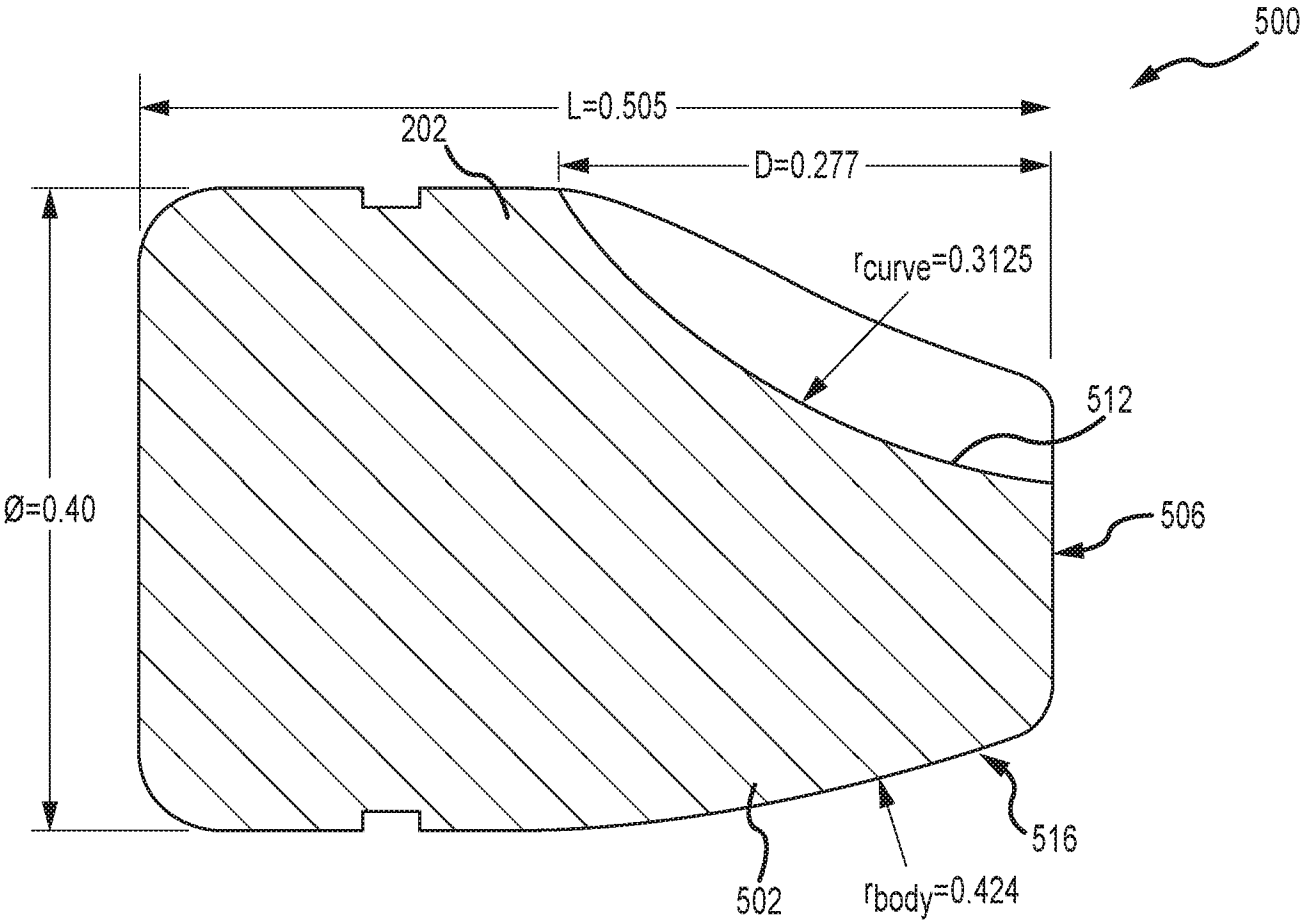

FIG. 4 depicts a perspective view of another example of an armor-piercing projectile. A number of components are depicted and described above in previous figures and as such are not necessarily described further. In relevant part, the projectile 300 includes four flutes 308 and four fins 304. An included angle α is about 90°. Geometric relationships for a four flute/fin configuration are depicted below.

Table 1 depicts geometric relationships for projectiles having fins and flutes as described herein. In general, these geometric relationships enable a projectile to transmit sufficient force as it enters a wet target so as to create a cavity. Geometric relationships outside these ranges may not transmit sufficient force to the wet target and, as such, may not produce a desired cavity. In certain examples, however, geometric relationships outside of these ranges may, in fact, produce the desired results. In that regard, Table 1 depicts a number of exemplary relationships that have been discovered to be desirable, but other relationships and dimensions are contemplated and may be achieved by a person of skill in the art without undue experimentation, based on the disclosure provided herein. More specifically, the optimum flute volume $V_F$ is depicted for a three flute configuration. The minimum flute volume $V_F$ is generally the minimum required to produce the desired cavity in a wet target. For a three flute example, a flute included angle α of about 120° is desirable. Two flute configurations may have an included angle of about 150°, while four flute configurations may have an included angle of about 90°. It has also been determined that a fin width t greater than 0.05" may prevent the projectile from adequately penetrating barriers. The meplat diameter $\phi_{MEP}$ is not depicted but may vary depending on the configuration of the firearm firing the projectile. In general, it is desirable that the meplat diameter $\phi_{MEP}$ is as large as possible while still being able to be fed within the firearm. In examples, the meplat diameter $\phi_{MEP}$ is about 45% to about 55% of the outside diameter ϕ. In another examples, a meplat diameter $\phi_{MEP}$ of about 50% or about 52% of the outside diameter ϕ may be desirable. Projectiles having weights of up to about 75 grains, 78 grains, 105 grains, and so on, are contemplated. For example, a projectile of less than 75 grains with a diameter ϕ of about 0.353" to about 0.359" is contemplated. In another example, a projectile of less than 105 grains with a diameter ϕ of about 0.399" to about 0.404" is contemplated.

TABLE 1

FLUTED PROJECTILE GEOMETRY RELATIONSHIPS

| Outside | Flute Volume $V_F$ (cc) | | | | Fin Width t (in) | |
|---|---|---|---|---|---|---|
| Diameter ϕ (in) | Optimum | Minimum | Flute Included Angle α (°) | Flute Number | Optimum | Minimum |
| 0.312 | 0.112 | 0.075 | 90-150 | 2-4 | 0.026 | 0.05 |
| 0.355 | 0.128 | 0.086 | 90-150 | 2-4 | 0.026 | 0.05 |
| 0.4 | 0.144 | 0.097 | 90-150 | 2-4 | 0.026 | 0.05 |
| 0.429 | 0.151 | 0.104 | 90-150 | 2-4 | 0.026 | 0.05 |
| 0.451 | 0.162 | 0.109 | 90-150 | 2-4 | 0.026 | 0.05 |
| 0.452 | 0.162 | 0.109 | 90-150 | 2-4 | 0.026 | 0.05 |
| 0.5 | 0.216 | 0.145 | 90-150 | 2-4 | 0.026 | 0.05 |

Example 1

In a view of the geometric relationships depicted in Table 1, an example projectile consistent therewith is presented in FIGS. 5A-5E. The reference numerals utilized in FIGS. 5A-5E are consistent with those depicted above. Accordingly, those elements are generally not necessarily described further. The projectile 500 is manufactured to the following specifications, identified in Table 2 below. Manufacturing tolerances are not reflected in the figures or Table 2.

TABLE 2

EXAMPLE 1 DIMENSIONS

| Dimension | Inches (unless noted) |
|---|---|
| Body Length, L | 0.505 |
| Body Caliber, Ø | 0.40 |
| Meplat Diameter, $Ø_{MEP}$ | 0.212 |
| Flute Length, $L_F$ | 0.277 |
| Curved Surface Radius, $r_{curve}$ | 0.3125 |
| Outer Surface Radius, $r_{body}$ | 0.424 |
| Fin Minimum Thickness, t | 0.026 |
| Flute Volume, $V_F$ | 0.144 cc |
| Included Angle, α | 120° |

The projectile described in accordance with EXAMPLE 1 was discharged at a subsonic velocity from a weapon into a 10% ordnance gelatin test block. The results of this test are presented below.

Test Summary:

A 78 gr projectile (as described in EXAMPLE 1) was used. The projectile was fired from a Browning Hi-Power Pistol having a barrel length of 4.75".

| Projectile Specification: | |
|---|---|
| Weight | 78 gr |
| Length | 0.505" |
| Flutes | 3 at 120° |

Ordnance Gel Specification:

The projectile was discharged into a 10% ballistic ordnance gelatin test block manufactured and calibrated in accordance with the FBI Ammunition Testing Protocol, developed by the FBI Academy Firearms Training Unit. The base powder material utilized for the 10% ordnance gelatin test block was VYSE™ Professional Grade Ballistic & Ordnance Gelatin Powder available from Gelatin Innovations, of Schiller Park, Ill. The block was manufactured at the test site in accordance with the formulations and instructions provided by the powder manufacturer. After manufacture of the gelatin test block, the test block was calibrated. Calibration requires discharging a 0.177 steel BB at 584 feet per second (fps), plus or minus 15 fps, into the gelatin test block. The test block is considered calibrated if the shot penetrates 8.5 centimeters (cm), plus or minus 1 cm (that is, 2.95 inches-3.74 inches). The calibrated block is then used in the terminal performance testing of the projectile.

| Terminal Performance Testing: | |
|---|---|
| Shot Velocity | 1,630 fps |
| Temporary Cavity (TC) Length | 14" approximate |
| TC Max. Diameter | 4.125" approximate |
| Length of TC at Max. Diameter | 3.75" approximate |
| Maximum Penetration Depth | 17.75" approximate |
| Projectile Weight Retained | 78 gr |
| Average Projectile Expansion Diameter | 0.353" approximate |
| Largest Projectile Diameter | 0.355" approximate |

As can be seen, there is very little change in the diameter of the projectile, which indicates that the projectile does not deform upon impact. As such, the cavity is formed by the hydraulic forces caused by the expulsion of fluid from the flutes. The projectile, when utilized in a cartridge having an appropriate casing and primer, can be fed from a magazine of virtually any capacity, in both automatic and semi-automatic weapons.

Figure 6A:
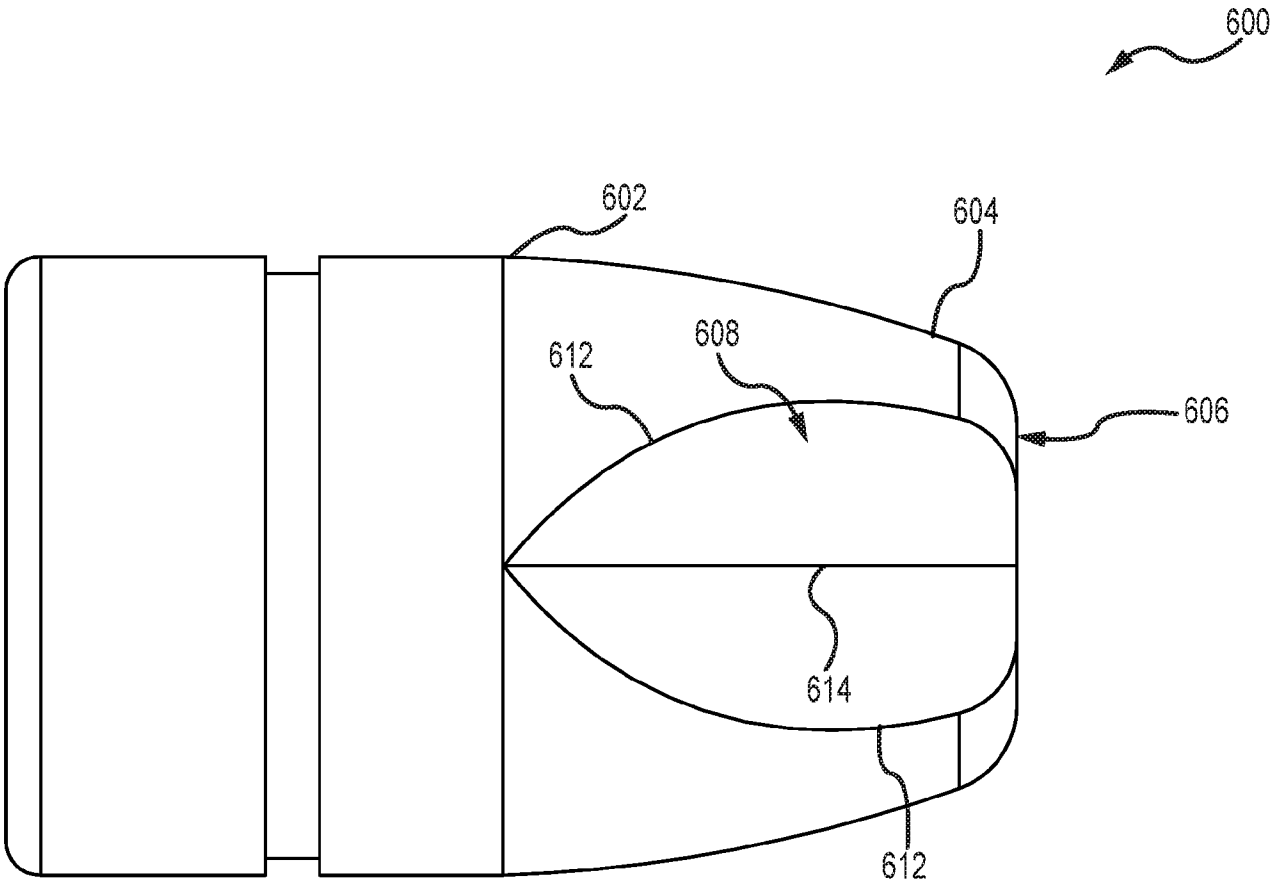
FIG. 6A is a side view of yet another embodiment of a projectile.
Figure 6B:
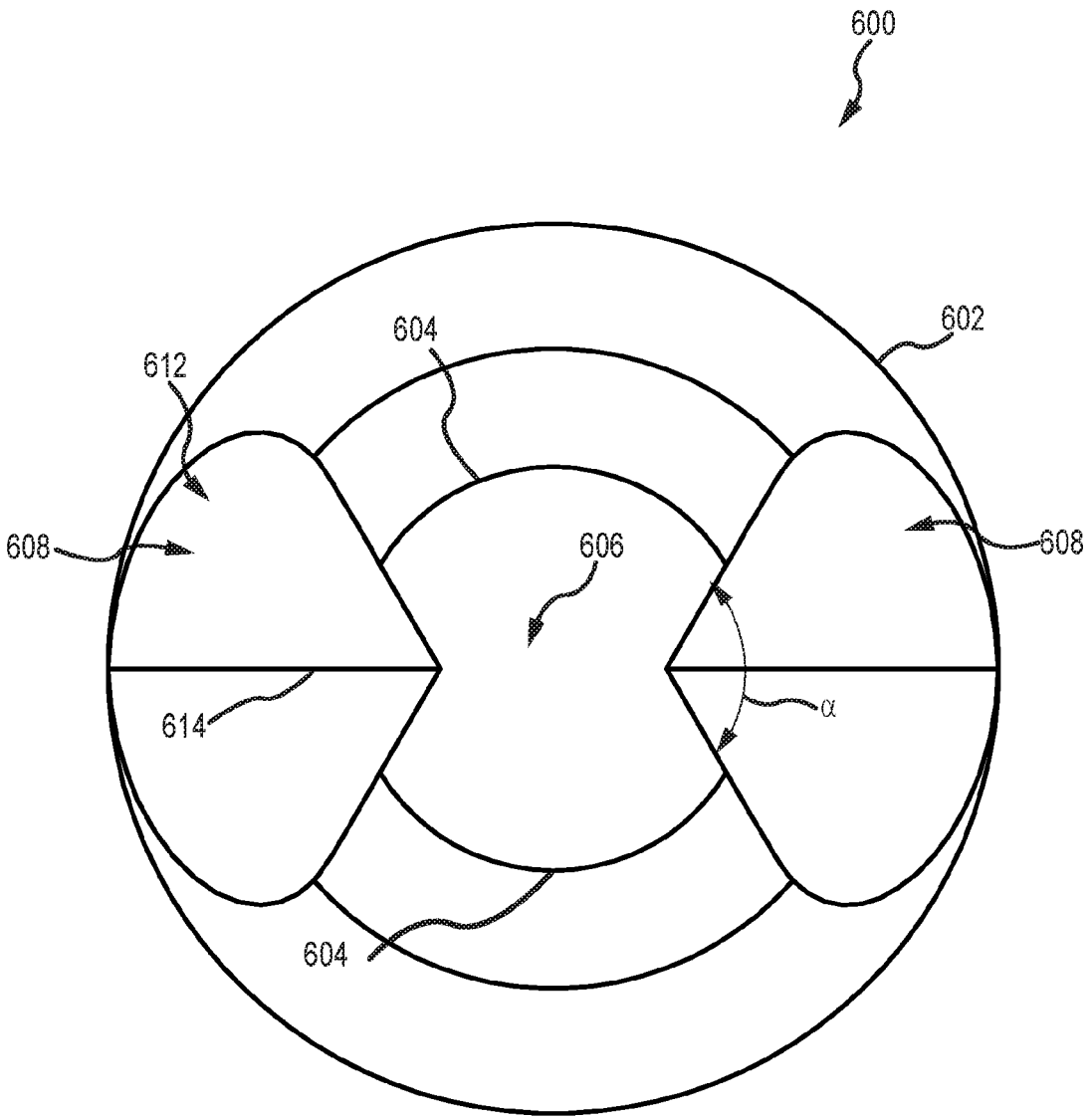
FIG. 6B is a front view of the projectile shown in FIG. 7A.

FIG. 6A is a side view of yet another embodiment of a projectile 600. FIG. 6B is a front view of the projectile 600. Referring to FIGS. 6A-B, the projectile 600 includes a body 602 that includes fins 604 that form a meplat 606. In the depicted example, the projectile 200 includes two fins 604 that are spaced from each other by, and define, a corresponding number of longitudinal flutes 608. The flutes 608 are each defined by two curved surfaces 612 that also form surfaces of the fins 604. The curved surfaces 612 intersect at an inner intersection curve 614 that is radially equidistant from adjacent fins 604. In this example, each flute 608 has an included angle $\alpha$ of about 150°.

Manufacture of projectiles consistent with the technologies described herein may be by processes typically used in the manufacture of other projectiles. The projectiles may be cast from molten material, or formed from powdered metal alloys. Projections in the mold may form the depicted flutes, or the flutes may be cut into the projectiles after casting. The projectiles, casings, primers, and propellants may be assembled using one or more pieces of automated equipment.

Unless otherwise indicated, all numbers expressing dimensions, speed, weight, and so forth used in the specification and claims are to be understood as being modified in all instances by the term "about." Accordingly, unless indicated to the contrary, the numerical parameters set forth in the specification and attached claims are approximations that may vary depending upon the desired properties sought to be obtained by the present technology.

As used herein, "about" refers to a degree of deviation based on experimental error typical for the particular property identified. The latitude provided the term "about" will depend on the specific context and particular property and can be readily discerned by those skilled in the art. The term "about" is not intended to either expand or limit the degree of equivalents that may otherwise be afforded a particular value. Further, unless otherwise stated, the term "about" shall expressly include "exactly," consistent with the discussions regarding ranges and numerical data. Lengths, sizes, and other numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. This same principle applies to ranges reciting only one numerical value. Furthermore, such an interpretation should apply regardless of the breadth of the range or the characteristics being described.

Notwithstanding that the numerical ranges and parameters setting forth the broad scope of the invention are approximations, the numerical values set forth in the specific examples are reported as precisely as possible. Any numerical value, however, inherently contain certain errors necessarily resulting from the standard deviation found in their respective testing measurements.

While there have been described herein what are to be considered exemplary and preferred embodiments of the present technology, other modifications of the technology will become apparent to those skilled in the art from the teachings herein. The particular methods of manufacture and geometries disclosed herein are exemplary in nature and are not to be considered limiting. It is therefore desired to be secured in the appended claims all such modifications as fall within the spirit and scope of the technology. Accordingly, what is desired to be secured by Letters Patent is the technology as defined and differentiated in the following claims, and all equivalents.

What is claimed is:

1. A projectile comprising:

a body having three fins, wherein the three fins at least partially define:

a meplat; and three flutes alternatingly arranged with the three fins about an axis of the body;

wherein each fin has a curved surface extending from the meplat to a side surface of the body; and wherein each of the three flutes is at least partially defined by the curved surface of the fins having a substantially smooth radius of curvature that is substantially constant from the meplat to the side surface.

2. The projectile of claim 1, wherein the meplat comprises a meplat surface substantially orthogonal to the axis.

3. The projectile of claim 2, wherein the meplat comprises a meplat portion extending substantially along the axis and away from the meplat surface.

4. The projectile of claim 1, wherein each of the three flutes is at least partially defined by two curved surfaces, wherein the two curved surfaces intersect at an intersection curve defined by the radius of curvature.

5. The projectile of claim 1, wherein the body has a maximum outside diameter and the meplat has a meplat diameter about 50% of the maximum outside diameter.

6. The projectile of claim 5, wherein each of the three flutes defines a flute length between about 50% to about 55% of a body length.

7. The projectile of claim 6, wherein each of the three flutes defines a flute length between about 52% of the body length.

8. The projectile of claim 1, wherein each flute has an included angle of about 120°.

9. A projectile comprising:

a meplat surface;

a base surface; and a body having an outer surface, the body extending along an axis from the meplat surface to the base surface, wherein the body comprises a plurality of fins, wherein each of the plurality of fins is defined by:

the meplat surface;

the outer surface; and a pair of curved surfaces, wherein adjacent curved surfaces of adjacent fins intersect at an intersection curve disposed radially equidistant from the adjacent fins.

10. The projectile of claim 9, wherein adjacent curved surfaces of adjacent fins define a substantially symmetrical flute.

11. The projectile of claim 10, wherein the body defines two flutes, wherein each flute has an included angle of about 150°.

12. The projectile of claim 10, wherein the body defines three flutes, wherein each flute has an included angle of about 120°.

13. The projectile of claim 10, wherein the body defines four flutes, wherein each flute has an included angle of about 90°.

14. The projectile of claim 10, wherein the body has a maximum outer diameter of about 0.50" and at least one curved surface has a radius of about 0.3125".

15. The projectile of claim 10, wherein the body has a maximum outer diameter of about 0.50" and at least one flute has a flute volume of about 0.216 cc.

16. A projectile comprising:

a body comprising:

an axis;

a meplat substantially orthogonal to the axis;

a plurality of substantially symmetrical fins defining and separated by a plurality of substantially symmetrical flutes; and wherein each flute is formed by two curved surfaces of the fins that intersect at an intersection curve.

17. The projectile of claim 16, wherein, at a leading point, the two curved surfaces comprise substantially similar radii of curvature.

18. The projectile of claim 16, wherein each of the plurality of substantially symmetrical flutes is symmetrical about the intersection curve.

19. The projectile of claim 16, wherein the plurality of substantially symmetrical flutes comprises three substantially symmetrical flutes.

20. The projectile of claim 16, wherein each of the plurality of symmetrical fins comprises a chisel.

* * * * *